US009284730B2

(12) United States Patent
Klein

(10) Patent No.: US 9,284,730 B2
(45) Date of Patent: Mar. 15, 2016

(54) CONTROL JOINT BACKER AND SUPPORT MEMBER ASSOCIATED WITH STRUCTURAL ASSEMBLIES

(76) Inventor: James A. Klein, Bellevue, WA (US)

( * ) Notice: Subject to any disclaimer, the term of this patent is extended or adjusted under 35 U.S.C. 154(b) by 0 days.

(21) Appl. No.: 13/342,927

(22) Filed: Jan. 3, 2012

(65) Prior Publication Data

US 2012/0297710 A1 Nov. 29, 2012

Related U.S. Application Data

(60) Provisional application No. 61/460,417, filed on Jan. 3, 2011.

(51) Int. Cl.

| | |
|---|---|
| ***E04C 2/00*** | (2006.01) |
| ***E04B 1/00*** | (2006.01) |
| ***E04B 1/94*** | (2006.01) |
| ***E04B 1/68*** | (2006.01) |
| ***E04B 1/686*** | (2006.01) |
| ***E04B 1/62*** | (2006.01) |
| ***E04B 2/74*** | (2006.01) |

(52) U.S. Cl.

CPC ..... *E04B 2/7457* (2013.01); *E04B 2/7411* (2013.01)

(58) Field of Classification Search

CPC ..... E04B 1/948; E04B 2/7457; E04B 2/7411; E04B 1/6815; E04B 2/825; E04B 1/5818

USPC ..... 52/202, 273, 281, 282.1, 254, 317, 290, 52/395, 396.01–396.09, 232

See application file for complete search history.

(56) References Cited

U.S. PATENT DOCUMENTS

| | | | | |
|---|---|---|---|---|
| 1,357,713 | A * | 11/1920 | Lane | 52/464 |
| 1,729,439 | A * | 9/1929 | Gordee | 52/241 |
| 3,465,488 | A * | 9/1969 | Miller | 52/481.1 |
| 3,481,090 | A * | 12/1969 | Lizee | 52/241 |
| 4,566,242 | A * | 1/1986 | Dunsworth | 52/396.01 |
| 4,805,364 | A | 2/1989 | Smolik | |
| 4,811,529 | A * | 3/1989 | Harris et al. | 52/396.01 |
| 4,854,096 | A | 8/1989 | Smolik | |
| 4,951,436 | A * | 8/1990 | Burkstrand et al. | 52/241 |
| 4,977,719 | A * | 12/1990 | LaRoche et al. | 52/396.01 |
| 5,127,203 | A | 7/1992 | Paquette | |
| 5,127,760 | A | 7/1992 | Brady | |
| 5,187,910 | A * | 2/1993 | Nicholas et al. | 52/317 |
| 6,131,352 | A * | 10/2000 | Barnes et al. | 52/396.01 |
| 6,854,237 | B2 * | 2/2005 | Surowiecki | 52/633 |
| 7,681,365 | B2 | 3/2010 | Klein | |
| 7,814,718 | B2 | 10/2010 | Klein | |
| 7,856,781 | B2 * | 12/2010 | Hilburn, Jr. | 52/394 |
| 7,866,108 | B2 | 1/2011 | Klein | |
| 8,056,293 | B2 | 11/2011 | Klein | |
| 8,353,139 | B2 * | 1/2013 | Pilz et al. | 52/232 |
| 2008/0172967 | A1 * | 7/2008 | Hilburn | 52/396.01 |
| 2011/0083383 | A1 * | 4/2011 | Hilburn, Jr. | 52/232 |

* cited by examiner

*Primary Examiner* — Phi A
*Assistant Examiner* — Omar Hijaz
(74) *Attorney, Agent, or Firm* — Thomas E. Loop

(57) ABSTRACT

The present invention is directed to a profile used to support fire retardant and or wall sheathing behind opposing wall sheathing edges, horizontally at head of walls, and behind control/reveal joint profiles. The profiles are shaped to support wall sheathing, intumescent stopping, and fire rated "rips" of wall sheathing and work in a manner that allows protection or support of intersecting opposing drywall edges.

3 Claims, 9 Drawing Sheets

CONTROL JOINT BACKER AND SUPPORT MEMBER ASSOCIATED WITH STRUCTURAL ASSEMBLIES

CROSS-REFERENCE TO RELATED APPLICATIONS

This application claims the benefit of priority to U.S. Provisional Application No. 61/460,417 filed on Jan. 3, 2011, all of which application is incorporated herein by reference in its entirety for all purposes.

TECHNICAL FIELD

The present invention relates generally to structural wall assemblies and, more particularly, to metal framing structural wall components, support members, and related assemblies configured to sealingly connect together opposing edges of adjacent pieces of wallboard positioned on a wall assembly.

BACKGROUND OF THE INVENTION

In the building construction industry metal framing assemblies are commonly used to construct commercial and residential buildings. Such metal framing assemblies are generally constructed from a plurality of metal framing members including studs, joist, trusses, and other metal posts and beams formed from sheet metal and frequently fabricated to have the same general cross-sectional dimensions as standard wood members used for similar purposes. Metal framing members are typically constructed by roll-forming 12 to 24 gauge galvanized sheet steel. Although many cross-sectional shapes are available, the primary shapes used in building construction are C-shaped studs and U-shaped tracks.

In the building construction trade, a head-of-wall joint (also sometimes referred to as a top-of-wall joint) refers to the linear junction or interface existing between a top section of a framing/wallboard wall assembly and the ceiling (where the ceiling may be a next-level floor or corrugated pan roof deck, for example). In common practice, a wall to ceiling connection of many newly constructed buildings consists essentially of an inverted U-shaped elongated steel channel (or track) configured to receive steel studs between the legs (also sometimes referred to as sidewalls or flanges) of the shaped channel. A wallboard is generally attached to at least one side of the studs. The studs and wallboard are in many instances spaced apart from the ceiling a short gap distance in order to allow for ceiling deflections caused by seismic activity or moving overhead loads. Similarly, wallboard is also commonly horizontally spaced apart as short gap distance from an immediately adjacent piece of wallboard (to thereby allow for thermal expansion and/or contraction of the wallboard without visible wall cracking). Exemplary steel stud wall constructions may be found in U.S. Pat. Nos. 4,854,096 and 4,805,364 both to Smolik, and U.S. Pat. No. 5,127,203 to Paquette. Exemplary dynamic head-of-wall systems having steel stud wall constructions may be found in U.S. Pat. No. 5,127,760 to Brady, and U.S. Pat. No. 6,748,705 to Orszulak et al.

In order to contain the spread of smoke and fire, a fire resistant material such as, for example, mineral wool is often times stuffed into the gaps between the ceiling and wallboard. For example, mineral wool is often stuffed between a steel header beam (e.g., an elongated U-shaped channel) and a corrugated steel roof deck (used in many types of steel and concrete building constructions); a fire resistant and generally elastomeric spray coating is then applied onto the exposed mineral wool to thereby form a fire resistant joint seal. In certain situations where the ceiling to wallboard gap is relatively small, a fire resistant and elastomeric caulk is commonly applied so as to fill any small gaps.

Intumescent materials have been used to seal certain types of construction gaps such as, for example, conduit throughholes. In this regard, intumescent and fire barrier materials (often referred to as firestop materials or fire retardant materials) have been used to reduce or eliminate the passage of smoke and fire through openings between walls and floors and the openings caused by through-penetrations (i.e., an opening in a floor or wall which passes all the way through from one room to another) in buildings, such as the voids left by burning or melting cable insulation resulting from a fire in a modern office building. Characteristics of fire barrier materials suitable for typical commercial fire protection use include flexibility prior to exposure to heat, the ability to insulate and/or expand, and the ability to harden in place upon exposure to fire (i.e., to char sufficiently to deter the passage of heat, smoke, flames, and/or gases). Although many such materials are available, the industry has long sought better and more effective uses of these materials and novel approaches for better fire protection, especially in the context of wall construction joints and gaps.

Among the few products and methods available for effectively and efficiently sealing head-of-wall construction joints and gaps (to thereby significantly enhance the ability of such joints and gaps to withstand smoke and fire penetration) are those sold under the tradename BLAZEFRAME, which products are protected under U.S. Pat. No. 7,681,365, U.S. Pat. No. 7,814,718, U.S. Pat. No. 7,866,108, and U.S. Pat. No. 8,056,293 all to Klein. In particular, the BlazeFrame line of technology addresses the need for adequate fire protection of dynamic head-of-wall systems associated with steel stud wall constructions.

Although advances have been made with respect to fire protection of structural wall assemblies, there is still a need in the art for new and improved structural wall assemblies and related components, especially in terms of products that allow for expansion and/or contraction of opposing pieces of wallboard fastened onto a wall assembly, while at the same time allowing for adequate fire protection. The present invention fulfills these needs and provides for further related advantages.

SUMMARY OF THE INVENTION

In brief, the present invention in one embodiment is directed to a wall assembly comprising first and second pieces of wallboard positioned adjacent to each other. The first and second pieces of wallboard are positioned apart from each other a short gap distance to thereby allow for thermal expansion and/or contraction of the wallboard without visible wall cracking.

These and other aspects of the present invention will become more evident upon reference to the following detailed description and attached drawings. It is to be understood, however, that various changes, alterations, and substitutions may be made to the specific embodiments disclosed herein without departing from their essential spirit and scope.

A—Single corrugation (pyramid shaped corrugation option)

B—Extra flanges at body ends (square shaped corrugation option)

C—Extra return flanges at end of flanges (rounded shaped corrugation option)

D—Extra return flange at one end and corrugation at opposing end of body.

Figure 1:
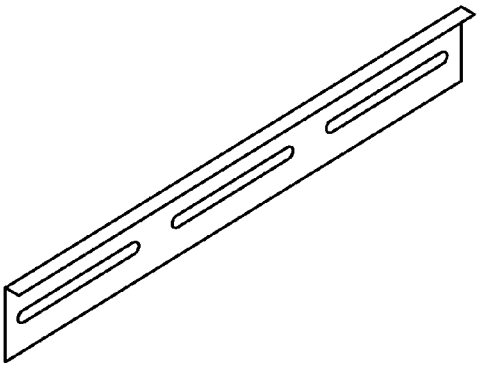
FIG. 1 is an offset view of an embodiment of the profile described in provisional claim 2 having slots located in what will become the vertical leg once the profile is installed.
Figure 2:
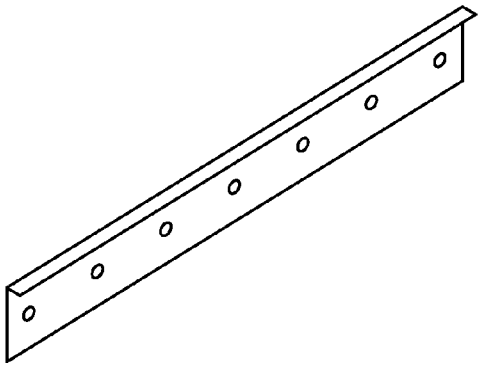
FIG. 2 is an offset view of an embodiment of the profile described in provisional claim having pre-punched alignment holes located in what will become the vertical leg once the profile is installed.
Figure 3:
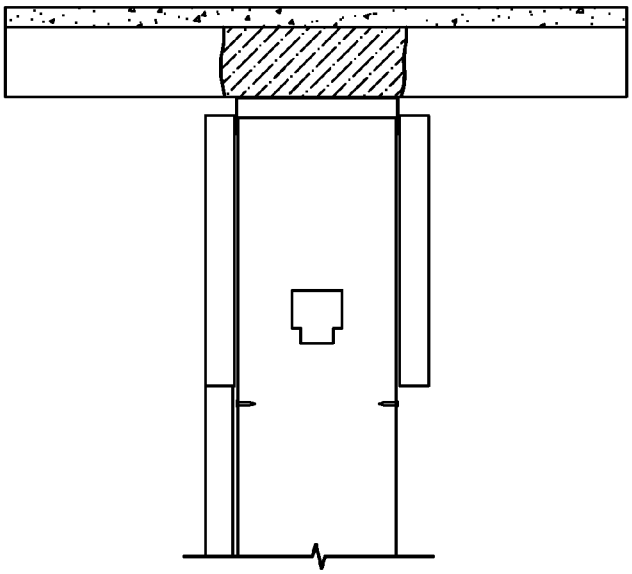
FIG. 3 is an end view of a wall assembly having a profile of provisional claims affixed to wall framing studs with the top sheet of the wall assembly on both sides in contact with the horizontal leg of the profile.
Figure 4:
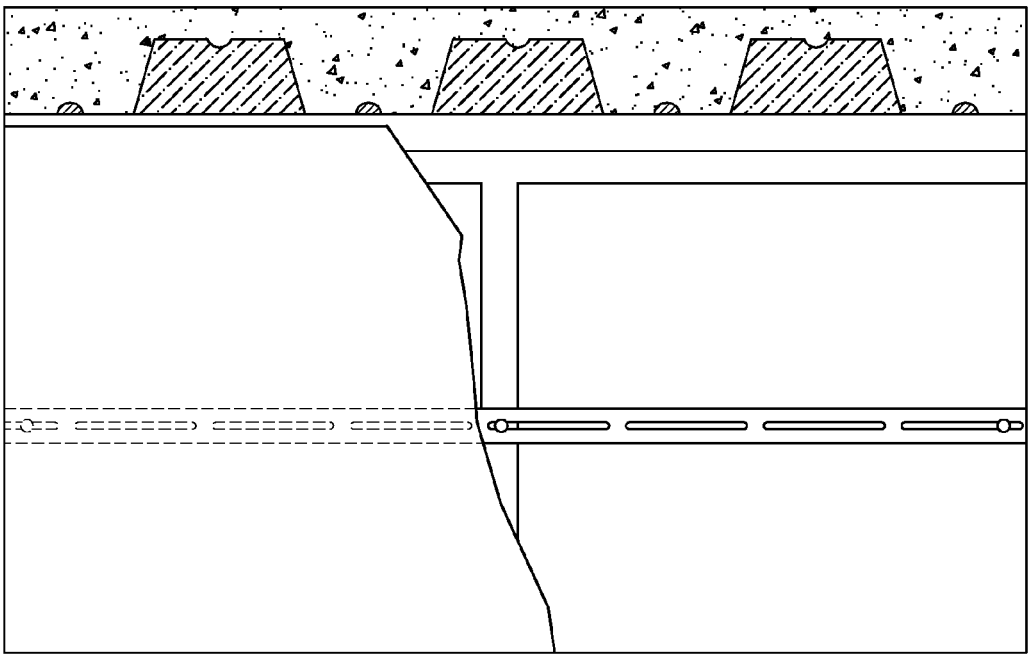
FIG. 4 is a frontal view showing the profile of provisional claim affixed to and bracing wall framing studs through pre-punched slots with the top sheet (cut away view) of a wall assembly in contact with the horizontal leg of the profile and a bottom sheet located below.
Figure 5:
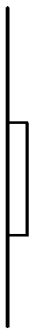
FIG. 5 is an end view of an embodiment of the invention of provisional claim with a flat strap and intumescent located in the center of the outside surface of the strap.
Figure 6:
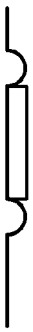
FIG. 6 is an end view of an embodiment of the invention of provisional claim with a flat strap having a minimum of one corrugation in the flat strap in the direction of the affixed intumescent.
Figure 7:
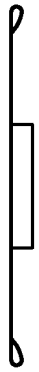
FIG. 7 is an end view of an embodiment of the invention of provisional claim with a flat strap having a minimum of one hemmed edge on the flat strap and affixed intumescent.
Figure 8:
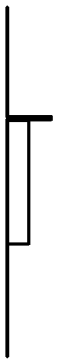
FIG. 8 is an end view of an embodiment of the invention of provisional claim having a profile with a minimum of one additional flange that extends outward in a perpendicular fashion from the base "flat strap" in the direction of the affixed intumescent.
Figure 9:
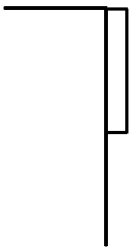
FIG. 9 is an end view of an embodiment of the invention having an angle profile of the base material (two flanges connected in perpendicular fashion) with an intumescent affixed to the outer surface of one flange.
Figure 10:
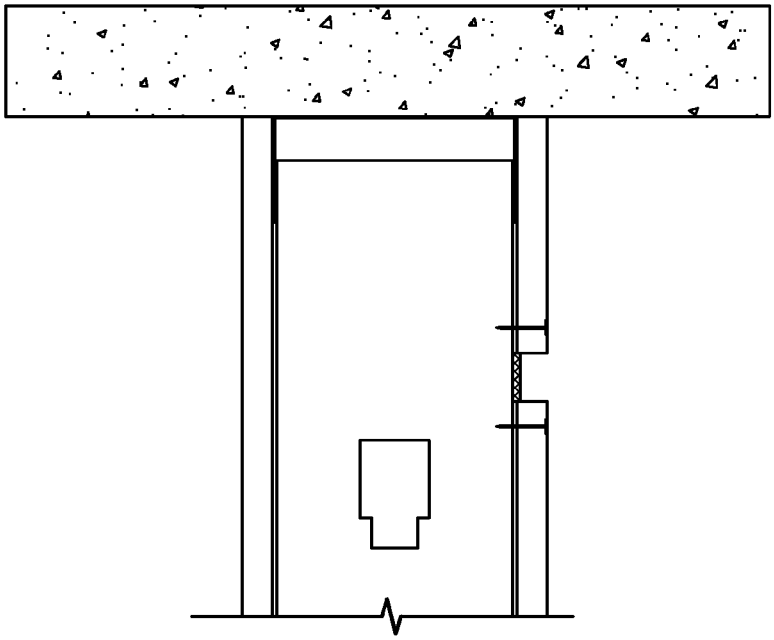
FIG. 10 is an assembly detail drawing showing the invention located on the "cavity" side of installed wall sheathing behind a gap between opposing wall board sheets.
Figure 11:
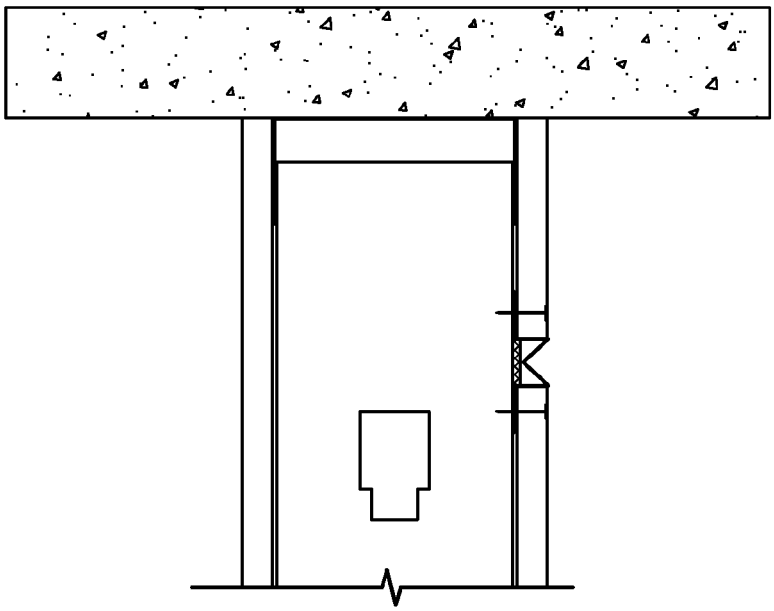
FIG. 11 is an assembly detail drawing showing the invention located on the "cavity" side of installed wall sheathing behind a gap between opposing wall board sheets having a control or reveal joint installed in and over the gap from the "finished" side.
Figure 12:
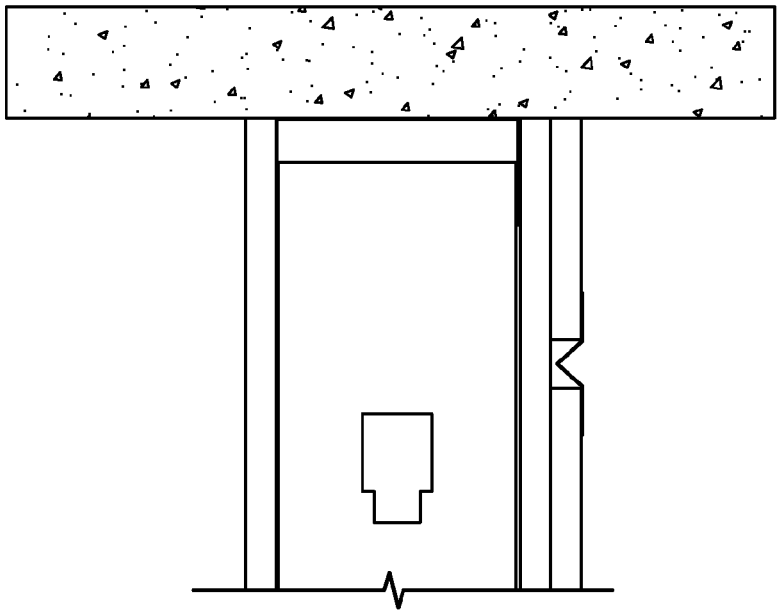
FIG. 12 is an assembly detail drawing showing prior art approach of installing a second layer of drywall behind the finish layer containing the control joint materials to maintain a 1 hour fire rating.
Figure 13:
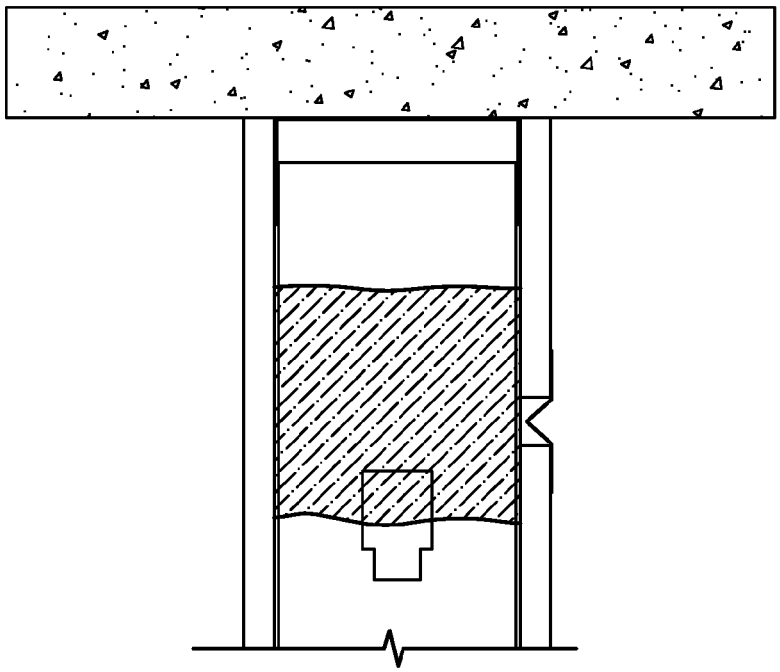
FIG. 13 is an assembly detail drawing showing prior art approach of installing mineral wool in the wall cavity behind the finish layer containing the control joint materials to maintain a 1 hour fire rating.
Figure 14:
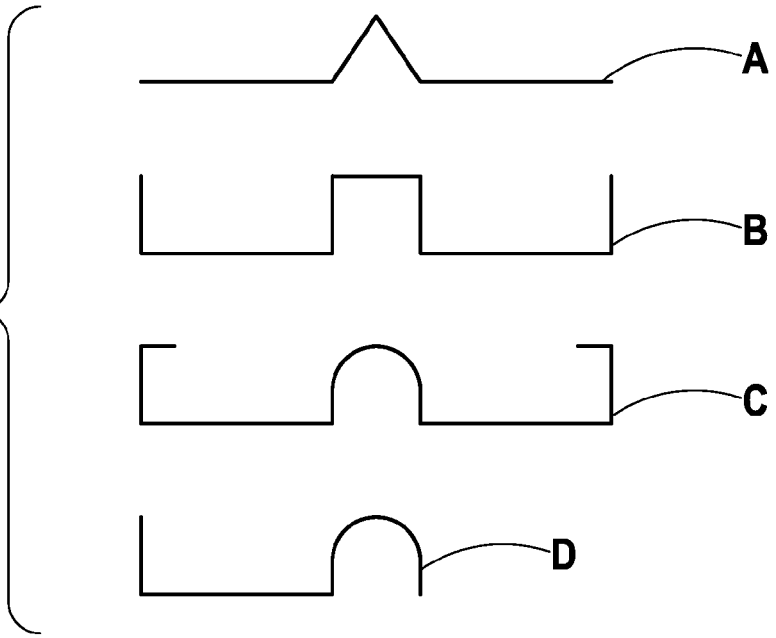
FIG. 14 is an end view of three possible embodiments of the invention in provisional claim.
Figure 15:
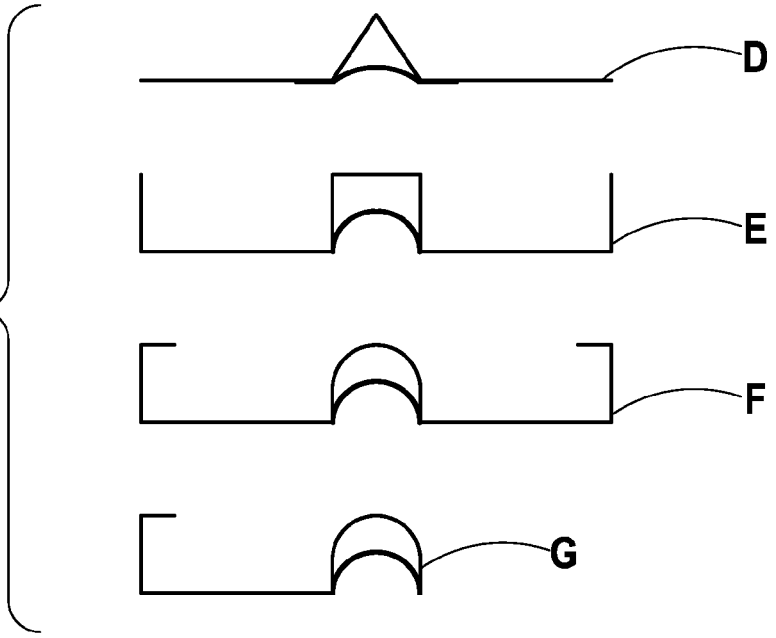

FIG. 15 is an end view of three possible embodiments of the invention with an affixed cured intumescent.

D—Single corrugation

E—Extra flanges at body ends

F—Extra return flanges at end of flanges

G—Extra return flanges at one end and corrugation at opposite end of body.

Figure 16:
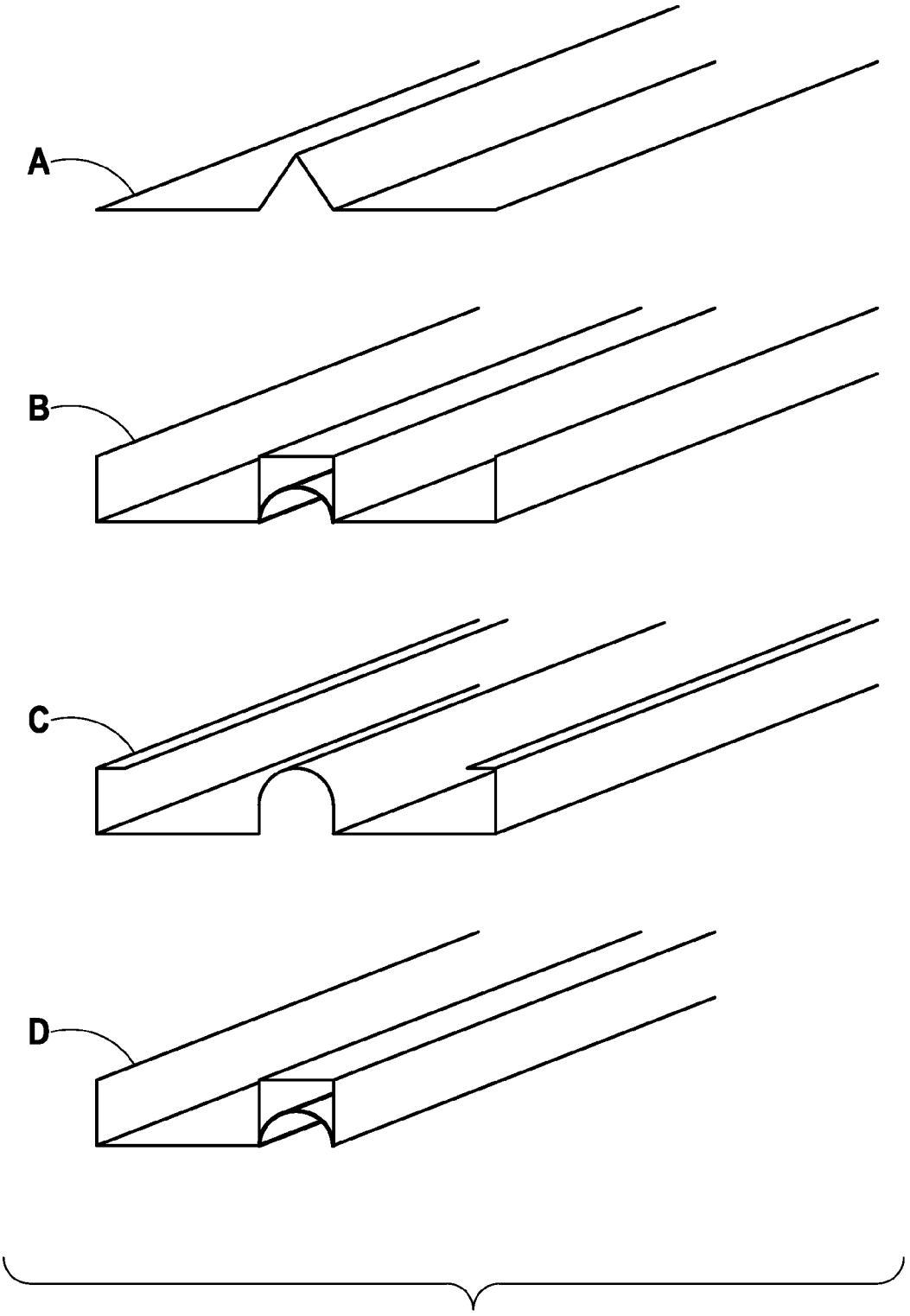

FIG. 16 is an offset view of three possible embodiments of the invention with an affixed cured intumescent (on exemplary item B and D only)

A—Single corrugation

B—Extra flanges at body ends

C—Extra return flanges at end of flanges

D—Extra return flange at one end and corrugation at opposite end of body

Figure 17:
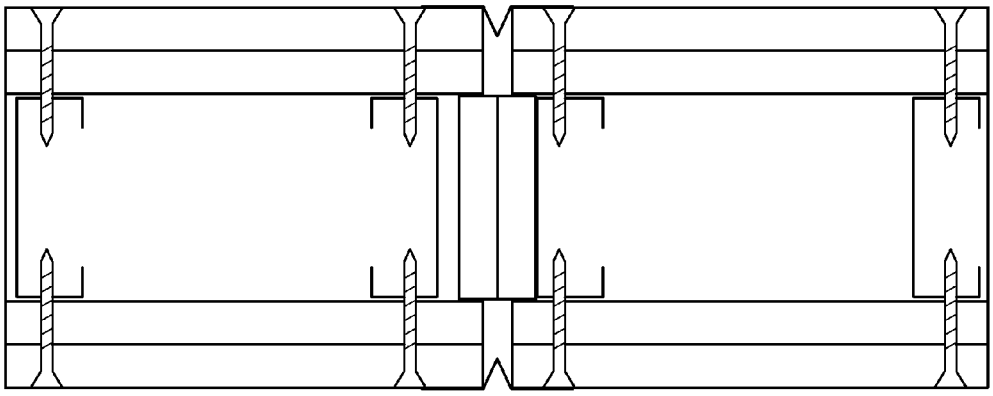

FIG. 17 is a top view of current methods of installation of control joints. Displayed are the 2 extra studs needed for drywall backing that span the wall cavity and either drywall rips or mineral wool "stuff" required to provide fire rating at control joint break in gypsum wall sheathing.

Figure 18:
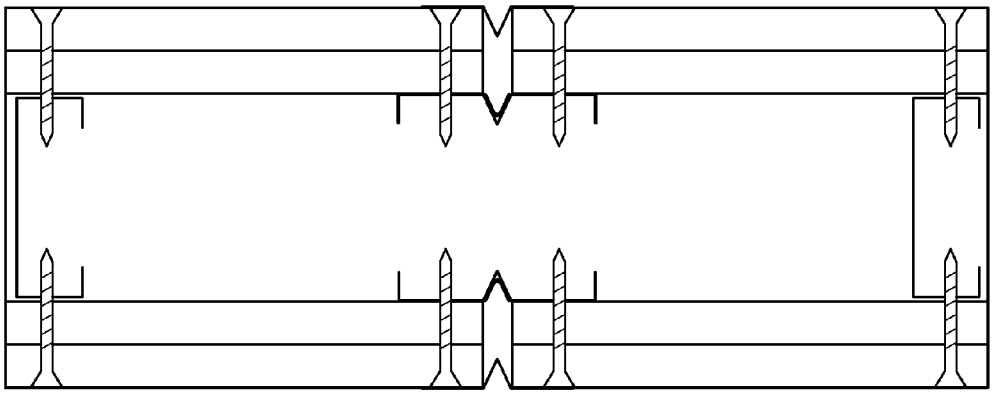

FIG. 18 is a top view showing use of the invention to support drywall edges and fire retardant materials behind the defined control joint on both sides.

Figure 19:
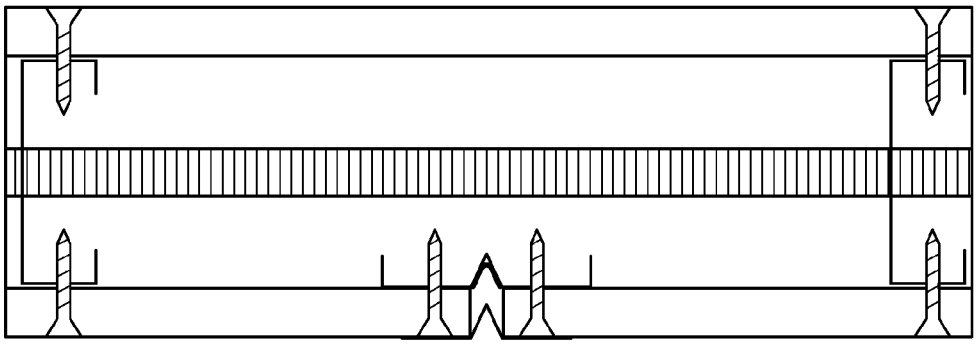

FIG. 19 is a top view showing use of the invention on one side of the wall with a "horizontal wall cavity obstruction" (i.e. pipe or wire conduit) located in the wall cavity. The invention provides support of the gypsum board edges, fire stop material and doesn't become a wall cavity obstruction. Being formed to flex horizontally and of a size creating little intrusion allows invention installation during wall board installation post cavity obstructions. A control joint can also extend into the gap without encumbrance from any fire stopping materials in the joint.

Figure 20:
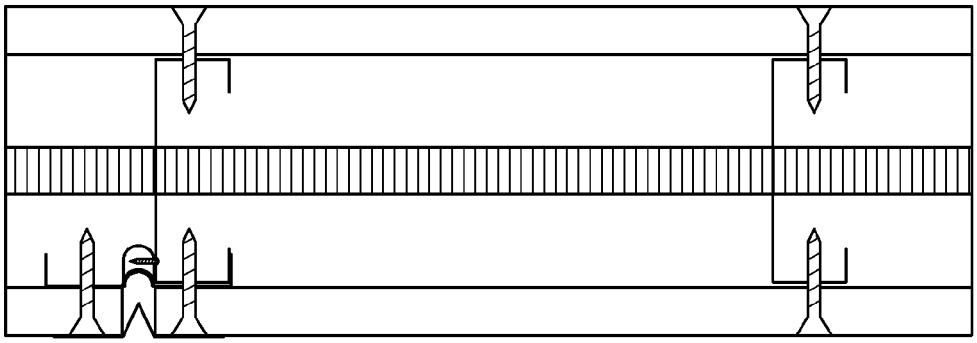

FIG. 20 is a top view showing use of an embodiment located on and attached to the "hard side" of a wall framing stud member.

Figure 21:
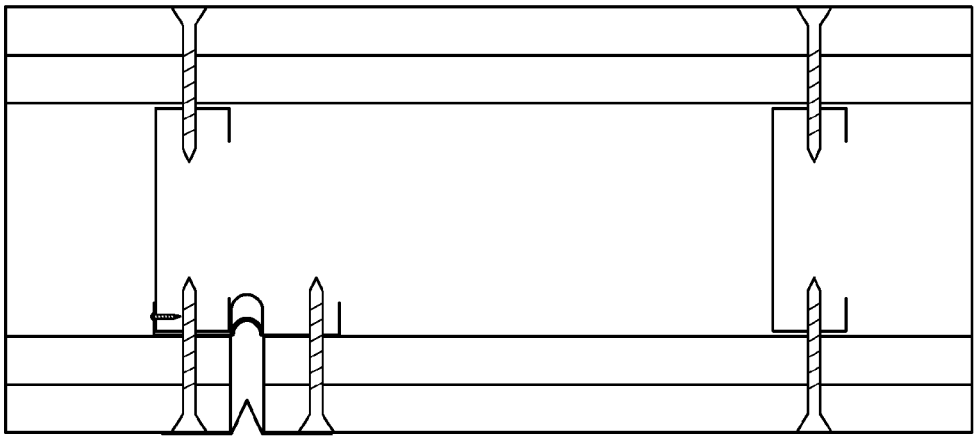

FIG. 21 is a top view showing the use of an embodiment with the corrugation located on the "soft side" of a wall framing stud member attached to the hard side via a flange of the profile.

DETAILED DESCRIPTION OF THE INVENTION

Referring to the drawings as appropriate, the present invention is directed to an angle support profile cooperative with walls and partitions of a building providing bracing of wall framing studs, vertical support of wall sheathing, a horizontal ledge to support the weight of wall sheathing material resting upon the ledge with the ledge having a distance shorter that the thickness of the wall sheathing.

The inventive profile may have a minimum of one horizontal slot in the vertical leg that allows for attachment of a fastener through to secure a wall framing "stud" and which the slot is wide and long enough to allow for the fastener attaching the stud to slide horizontally.

The inventive profile may have a minimum of one pre-punched hole in the vertical leg that allows for attachment of a fastener through to secure a wall framing "stud".

A wall assembly utilizing any of the above-described profiles with the profile attached through the vertical leg to a minimum of one wall stud and having a minimum of one of the "top sheets" of the wall assembly in contact with a portion of the horizontal "ledger" leg of the profile.

A metal/intumescent composite formed from a "flat stock" piece of metal having an inner surface and outer surface with an intumescent material affixed to a portion of the outer surface area and having a minimum of one corrugation in the flat stock directed outward from the outer surface and/or having a minimum of one of the edges of the flat stock hemmed outward towards the affixed intumescent material and/or having the affixed intumescent located in a manner which exposes a portion of the metal material on both sides of the intumescent creating "free and open" ends.

An angle profile having two flanges connected in a perpendicular fashion and an intumescent material composite where the intumescent is attached to the outside surface of one flange at the intersection of both flanges.

The inventive profile may be located on the "cavity" side of installed wall or behind the outer surface layer of wall sheathing with the affixed intumescent on the outer surface of the embodiment directed outward from the wall framing materials and inward towards a gap between two opposed wall sheathing members or substrates.

The inventive profile may be located on the "cavity" side of installed wall sheathing with the affixed intumescent on the outer surface directed outward from the wall framing materials and inward towards a gap between two opposed wall sheathing members with a metal, vinyl, aluminum, or steel based control joint or reveal molding installed in and or over the defined joint from the "finished" side of the installed wall sheathing.

Stated somewhat differently, the present invention is directed to a wall assembly that comprises: a plurality of studs having upper and lower ends, the studs being vertically positioned relative to the ceiling and floor such that the uppers ends are engaged within a header track and the lower ends are engaged within a footer track; first and second pieces of wallboard attached to the plurality of studs, the first and second pieces of wallboard being adjacent to each other and separated apart from each other so as to define a control gap between them; a first strip of a sheet-metal material positioned within the wall and connecting the first and second pieces of wallboard together along the length of the control gap, the first material strip having a flexible first central portion that runs the length of the control gap and allows for expansion and contraction of the first and second pieces of wallboard without cracking; and a second strip of a sheet-metal material positioned on the wall and connecting the first and second pieces of wallboard together along the control gap, the first material strip having a flexible second central portion that runs the length of the control gap and allows for expansion and contraction of the first and second pieces of wallboard without cracking, and wherein the first and second strips seal the control gap from the interior and exterior wall spaces. As shown, an intumescent material strip positioned along the first central portion of the first material strip, the second central portion of the second material strip, or both.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing description, and all changes that come within the meaning and range of equivalency of the claims are to be embraced within their scope.

What is claimed is:

1. A two component control joint backer assembly in combination with a wall assembly, comprising:

a plurality of studs having upper and lower ends, the studs being vertically positioned relative to the ceiling and floor such that the uppers ends are engaged within a header track and the lower ends are engaged within a footer track;

first and second pieces of wallboard attached to the plurality of studs, the first and second pieces of wallboard being adjacent to each other and separated apart from each other so as to define a control gap between them, the first and second pieces of wallboard having inward and outward facing surfaces;

a first component of the two-component control joint backer assembly comprising a first strip of a sheet-metal positioned within the wall assembly and against the inward facing surfaces of the first and second pieces of wallboard, the first sheet-metal strip connecting the first and second pieces of wallboard together along the length of the control gap, the first sheet-metal strip having a first flexible central bend portion that runs along the length of the control gap and allows for lateral expansion and contraction of the first and second pieces of wallboard;

a second component of the two-component control joint backer assembly comprising a second strip of a sheet-metal positioned on the wall assembly and against the outward facing surfaces of the first and second pieces of wallboard, the second sheet-metal strip connecting the first and second pieces of wallboard together along the length of the control gap, the second sheet-metal strip having a second flexible central bend portion that runs the length of the control gap and allows for lateral expansion and contraction of the first and second pieces of wallboard, the second flexible central bend portion being positioned within the control gap, and wherein the first and second sheet-metal strips seal the control gap; and an intumescent material strip positioned along and within the first flexible central bend portion of the first sheet-metal strip and above and spaced apart from a surface of the first flexible central bend portion of the first sheet-metal strip to thereby define an expansion gap that runs the length of the first flexible central bend portion of the first sheet-metal strip.

2. The two component control joint backer assembly in combination with the wall assembly of claim 1 wherein the first flexible central portion of the first sheet-metal material strip has a V-shaped cross-sectional profile.

3. The two component control joint backer assembly in combination with the wall assembly of claim 1 wherein the first flexible central portion of the first sheet-metal material strip has a U-shaped cross-sectional profile.

* * * * *